US005271539A

United States Patent [19]

Ozawa et al.

[11] Patent Number: 5,271,539

[45] Date of Patent: Dec. 21, 1993

[54] PRESSURE TYPE AUTOMATIC POURING FURNACE FOR CASTING

[75] Inventors: Michiharu Ozawa; Kiyoshi Shibuya; Fumio Kogiku, all of Chiba, Japan

[73] Assignee: Kawasaki Steel Corporation, Japan

[21] Appl. No.: 26,260

[22] Filed: Mar. 4, 1993

Related U.S. Application Data

[63] Continuation of Ser. No. 893,609, Jun. 3, 1992, abandoned, which is a continuation of Ser. No. 58,998, Jun. 8, 1987, abandoned.

[30] Foreign Application Priority Data

Jun. 9, 1986 [JP] Japan ..... 61-131918

[51] Int. Cl.[5] ..... B67D 1/04

[52] U.S. Cl. ..... 222/595; 222/593; 164/309; 266/239

[58] Field of Search ..... 222/593, 595; 164/335, 164/309; 266/239

[56] References Cited

U.S. PATENT DOCUMENTS

| | | | |
|---|---|---|---|
| 2,674,640 | 4/1954 | Tama | 222/595 X |
| 3,163,897 | 1/1965 | Sylvester | 164/309 X |
| 3,404,725 | 10/1968 | Kapun | 222/595 X |
| 3,844,453 | 10/1974 | Eickelberg | 222/595 |
| 4,441,191 | 4/1984 | Fredrikson et al. | 222/593 X |
| 4,638,980 | 1/1987 | Beele | 266/239 X |

FOREIGN PATENT DOCUMENTS

| | | | |
|---|---|---|---|
| 464012 | 3/1973 | Australia | 164/309 |
| 887917 | 7/1981 | Belgium . | |
| 1460971 | 12/1966 | France | 164/335 |
| 47-45646 | 11/1972 | Japan | 222/595 |
| 474302 | 6/1969 | Switzerland . | |
| 774795 | 10/1980 | U.S.S.R. | 222/595 |
| 21167 | of 1911 | United Kingdom | 164/309 |

OTHER PUBLICATIONS

Giesserei, vol. 70, No. 9, May 2, 1983, pp. 268-274, Dusseldorf, DE; M. Ogrissek: "Giesseinrichtungen fur Gusseisenbestehende und neue steuersysteme und deren Anwendung".

*Primary Examiner*—Gregory L. Huson
*Attorney, Agent, or Firm*—Austin R. Miller

[57] ABSTRACT

A pressure type automatic pouring furnace is formed with a molten metal outlet which has an opening end opening at a lower elevation than the general portion of the floor of a molten metal chamber. Preferably, the molten metal chamber communicates with a groove type induction heater section at a lower section thereof so that the molten metal in the chamber can be effectively heated. In addition, the bottom wall of the molten metal outlet is declined for a given angle, e.g. 3° with respect to the horizontal plane so as to prevent the molten metal from accumulating within the outlet.

28 Claims, 4 Drawing Sheets

PRESSURE TYPE AUTOMATIC POURING FURNACE FOR CASTING

This application is a continuation of application Ser. No. 07/893,609, filed Jun. 3, 1992 and now abandoned, which is a continuation of application Ser. No. 07/058,998, filed Jun. 8, 1987 now abandoned.

BACKGROUND OF THE INVENTION

Field of the Invention

The present invention relates generally to an automatic pouring furnace which receives a molten metal and pours into a caster automatically. More specifically, the invention relates to a pressure type automatic pouring furnace which pours a limited amount of molten metal in the furnace by applying gas pressure.

Description of the Background Art

In recent years, automatic pouring furnaces have become popular as replacements for manual pouring by means of ladles. The automatic pouring furnaces take various systems for pouring the molten metal within the furnaces to casters. For example, pressure type, inclination type and electromagnetic pump type furnaces are available. Among such various pouring furnaces, the pressure type pouring furnaces are known as advantageous in view of their pouring accuracy and lower comsumption of electricity. The advantages of the pressure type automatic pouring furnaces have been confirmed in 'Fuji Review (Fuji Jiho)' 52, published on 1979, page 619, 'Mitsubishi Electric Technical Report (Mitsubishi Denki Giho)' 53, published on 1979, page 652, 'Mitsubishi Electric Technical Report (Mitsubishi Denki Giho)' 52, published on 1978, page 450.

In a typical construction, the pressure type automatic pouring furnace for casting comprises a sealingly enclosed molten metal chamber, a molten metal inlet and outlet extending upwardly from a portion of the molten metal chamber in the vicinity of the bottom of the chamber, and a groove type induction heater section communicating with the lower section of the molten metal chamber for heating the molten metal in the chamber. Upon pouring, a given base pressure P is introduced into the molten metal chamber for pre-leveling of the molten metal. Thereafter, additional shot pressure $\Delta P$ is introduced into the molten metal chamber for pouring the molten metal to the caster with a given speed which can be controlled by adjusting the magnitude of the shot pressure. Such construction of the pressure type automatic pouring furnace has been disclosed in Japanese Patent First (unexamined) Publication No. 53-33929.

The pressure type automatic pouring furnace of the type set forth above is applicable for continuous casting by supplying molten metal continuously or with given intervals.

The conventional pressure type automatic pouring furnace encounters a disadvantage that it requires the molten metal in the molten metal chamber at a level not lower than a minimum level. The minimum level of the molten metal is determined according to the level of the molten metal outlet opening to the molten metal chamber. In practice, in order to maintain the molten metal level higher than the minumum level, usually 30% to 50% to the maximum molten metal amount is required to be maintained within the molten metal chamber. When the molten metal in the chamber becomes lower than the minimum level, the possibility increases to allow the pressurized gas in the chamber to escape through the outlet. Maintaining more than a minimum amount of molten metal to keep the molten metal level higher than the minimum level requires removal of the molten metal in the chamber when the composition of the metal or alloy to use for casting is to be changed. This significantly lowers the yield in the casting operation, especially, when such automatic pouring furnace is used for a casting line in which a relatively large number of mutually different alloys are used for casting.

SUMMARY OF THE INVENTION

Therefore, it is an object of the present invention to provide a pressure type automatic pouring furnace which can minimize the required molten metal amount to be maintained in a molten metal chamber.

Another object of the invention is to provide a pressure type automatic pouring furnace for casting, which successfully avoids the possibility of escape of the pressurized gas from the molten metal chamber.

A further object of the invention is to provide a pressure type automatic pouring furnace which has a better pressurization characteristics than that of the conventional furnaces.

In order to accomplish the aforementioned and other objects, a pressure type automatic pouring furnace, in accordance with the present invention, is formed with a molten metal outlet which has an opening end opening at a lower elevation than the general portion of the floor of a molten metal chamber.

Preferably, the molten metal chamber is communicates with a groove type induction heater section at a lower section thereof so that the molten metal in the chamber can be effectively heated. In addition, the bottom wall of the molten metal outlet declines at a given angle. e.g. 3° toward the heating section with respect to the horizontal plane so as to prevent the molten metal from accumulating within the outlet.

According to one aspect of the invention the pressure type automatic pouring furnace for casting, comprises a furnace body defining a chamber for receiving a molten metal, a molten metal inlet extending through a furnace wall and having a first opening substantially at the bottom of the chamber, a molten metal outlet extending through the furnace wall and having a second opening exposed to the chamber and located at an elevation lower than the first opening, and a pressure means for introducing a pressure into the chamber for forcing the molten metal within the chamber to the molten metal outlet.

In the practical construction, the molten metal inlet and outlet are located at radially opposite positions. Further practically, the furnace body has a floor forming the bottom of the chamber, the floor being formed with a stepped down section opposed to the o second opening of the molten metal outlet. The second opening has its uppermost section oriented at an elevation substantially corresponding to the general section of the upper surface of the floor. By positioning the uppermost section of the second opening at the level corresponding to the upper surface of the general portion of the floor, a required minimum level of the molten metal in the chamber becomes the level of the uppermost section. This substantially reduces the required minimum amount of molten metal in the chamber In a further preferred construction, the floor is slanted from the side where the molten metal inlet is formed to the side where the stepped down section is formed. The pressure type automatic pouring furnace further comprises a groove defined in the floor and communicating with the stepped down section, the groove communicating with a heating means for heating the molten metal. The groove is slanted toward the heating means. Preferably, the groove is provided with a slant angle greater than or equal to 3° with respect to a horizontal plane.

In a practical embodiment, the heating means is a groove type induction heating device comprising an electric heater and means defining molten metal path surrounding the heater and communicating with the goove. The molten metal path defined in the groove type induction heating device is oriented at an elevation lower than the joining section of the groove.

In the alternative embodiment, the pressure type pouring furnace further comprises a heating means provided beneath the chamber and communicating with the bottom of the chamber. Similarly to the former case, the heating means is a groove type induction heating device comprising an electric heater and means defining a molten metal path surrounding the heater and communicating with the bottom of the chamber. The molten metal path defined in the groove type induction heating device opens to the bottom of the chamber.

In a further alternative embodiment, the pressure means comprises a pressure inlet defined above the chamber for introducing a pressurized gas into the chamber. The pressure type automatic pouring furnace further comprises an auxiliary pressure means associated with the molten metal inlet for introducing a pressurized gas into the chamber through the molten metal inlet.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiments, but are for explanation and understanding only.

In the drawings.

DESCRIPTION OF THE PREFERRED EMBODIMENT

Figure 1:
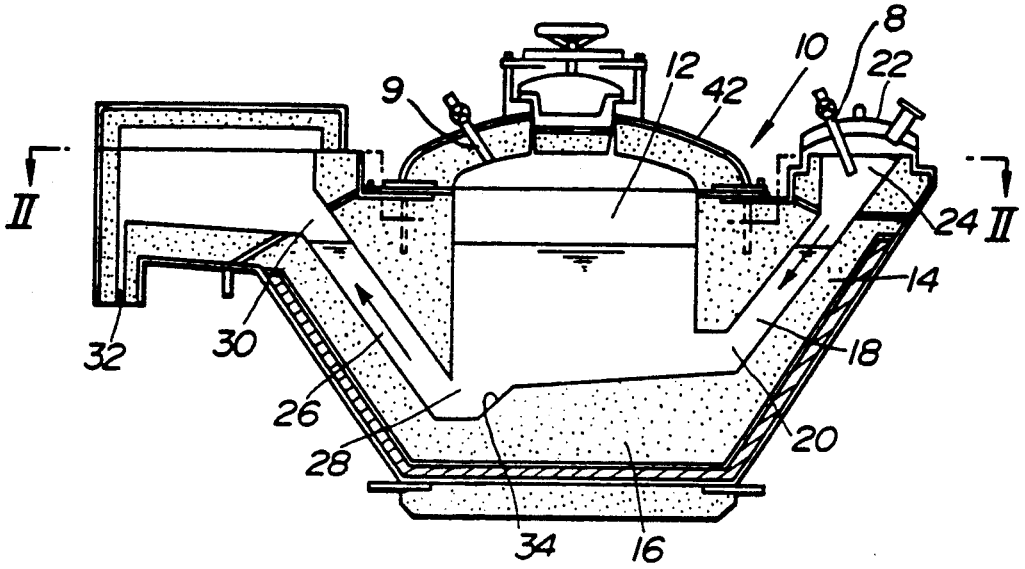
FIG. 1 is a cross-section of the preferred embodiment of a pressure type automatic pouring furnace according to the present invention.

Referring now to the drawings, particularly to FIGS, through 3, the preferred embodiment of a pressure type automatic pouring furnace, according to the present invention, has a furnace body 10 defining therein a molten metal chamber 12 by side wall 14 and floor 16. A molten metal inlet path 18 is defined through the side wall 14. The inlet path 18 opens to the molten metal chamber 12 at the inner end thereof. The inner end opening 20 of the inlet path 18 have the lowermost elevation corresponding to the elevation of the upper surface of the floor 16 of the molten metal chamber 12.

The inlet path 18 extends upwardly through the side wall 14 of the furnace with a given inclination angle. A closure 22 is provided for sealingly closing the outer end opening 24 of the inlet path 18 in air-tight fashion.

A molten metal outlet path 26 is also defined through the side wall 14 of the furnace 10. The outlet path 26 has an inner end 28 opening to the molten metal chamber 12. The outer end 30 of the outlet path 26 communicates with an outlet nozzle 32 in order to pour the molten metal to a caster or casting molding (not shown) therethrough. As seen from FIG. 1, the inner end 28 of the outlet path 26 has the lowermost elevation lower than that of the general upper surface of the floor 16. In the preferred arrangement, the uppermost section of the inner end 28 of the outlet path 26 is positioned at an elevation substantially corresponding to the elevation of the upper surface of the floor 16. In order to establish communication between the molten metal chamber 12 and the outlet path 26, a stepped down section 34 is formed on the floor 16 in communication with the inner end 28 of the outlet path 26.

As clearly seen from FIG. 1, the inlet path 18 and the outlet path 26 are located at opposite sides of the furnace 10. The upper surface of the floor 16 is slanted toward stepped down section 34, as indicated by the arrow $\alpha$ in FIG. 2.

Figure 2:
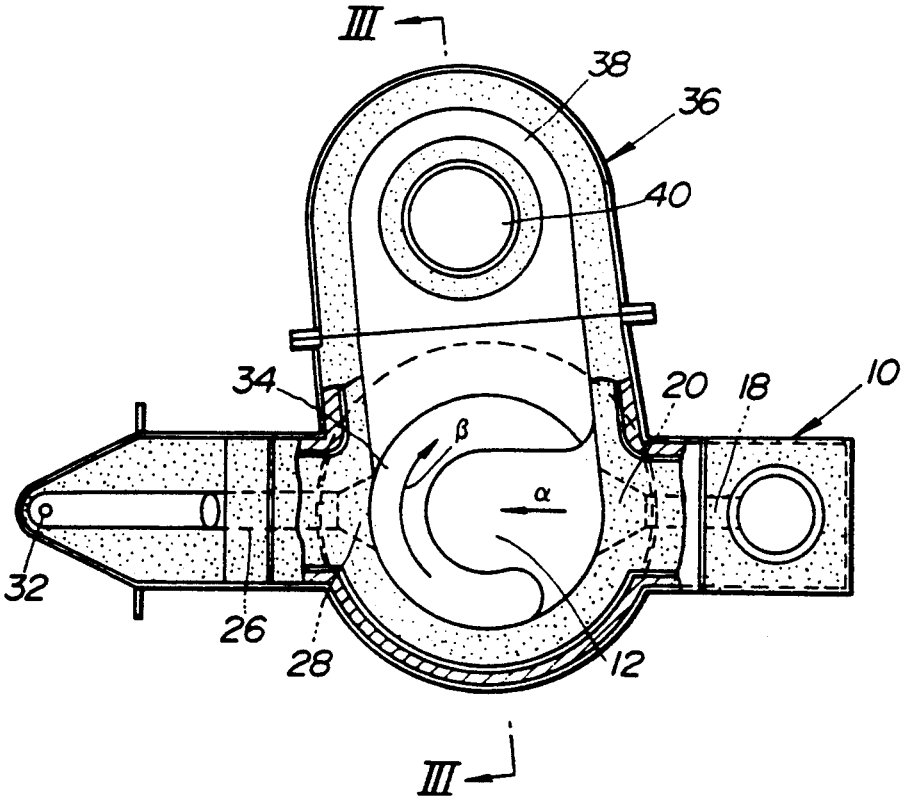
FIG. 2 is a section taken along line II—II of FIG. 1.
Figure 3:
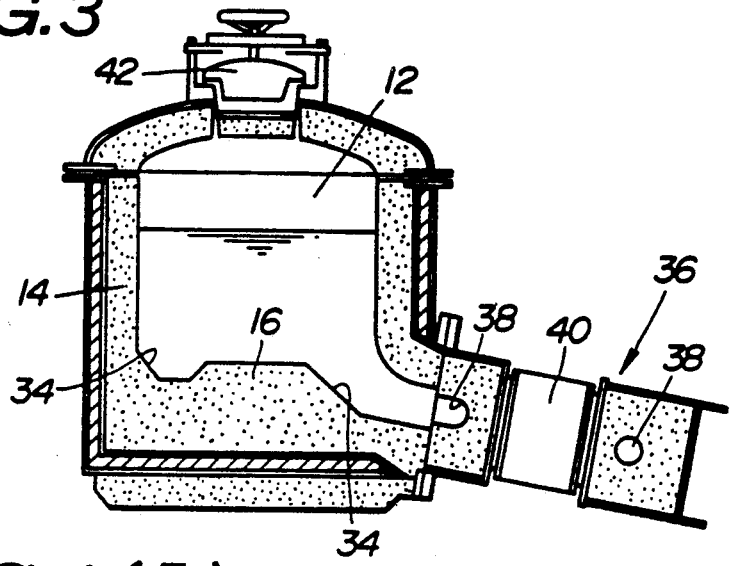
FIG. 3 is a section taken along line III—III of FIG. 2

As shown in FIG. 2, the stepped down section 34 extends in circumferential direction with a slant angle in a direction $\beta$. The slant angle in direction, in the preferred embodiment, is greater than 3°. A groove type induction heater section 36 is provided with the furnace 10. The heater section 36 has an essentially circular molten metal path 38 surrounding an induction heating device 40, which circular molten metal path is in communication with the lowermost portion of the stepped down section 34 of the floor 16.

The upper end of the molten metal chamber 12 is opened and openably closed by means of a closure lid 42. The closure lid 42 sealingly closes the opened upper end of the molten metal chamber 12 in air-tight fashion. The closure lid 42 is provided with a communication path 9 to introduce therethrough a pressurized gas. Also, if desired, the closure 22 closing the outer end of the inlet path 18 may also have a path 8 for introducing therethrough a pressurized gas. Providing the pressurized gas inlet for the closure 22 should be advantageous to effectively pressurize the molten metal chamber 12 and force the molten metal in the molten metal chamber to the outlet path.

It, should be noted that construction of the system for introducing the pressurized gas into the molten metal chamber 12 and control of the pressure for controlling the pouring speed has been disclosed in the Japanese Patent First (unexamined) Publication (Tokkai) Showa 53-33929, published on Mar. 40, 1978, for example. The disclosure of the Tokkai 53-33929 is herein incorporated by reference for the sake of disclosure.

Figure 4:
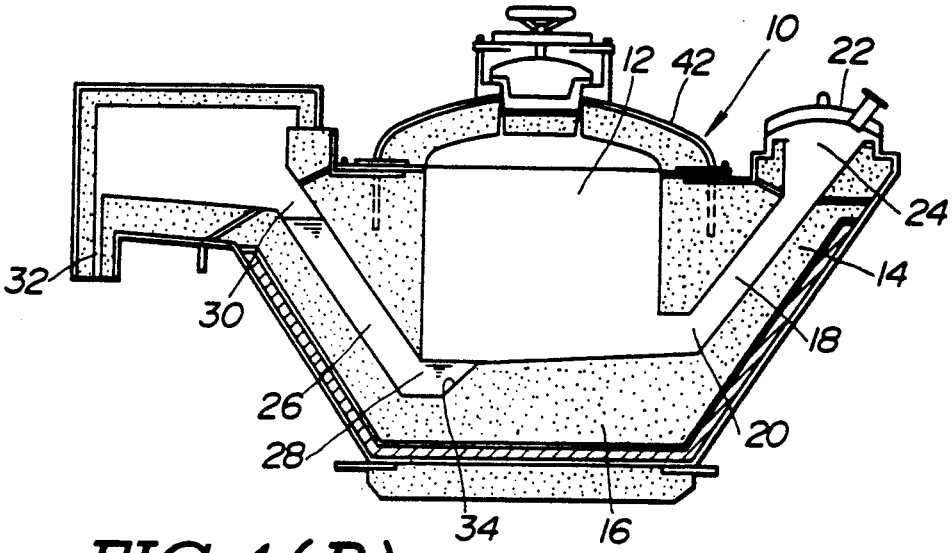
FIGS. 4 (A) and 4(B) are sections of the inventive furnace and conventional furnace, which sections are used for comparing required minimum molten metal amount in the present invention and the prior art.
Figure 4:
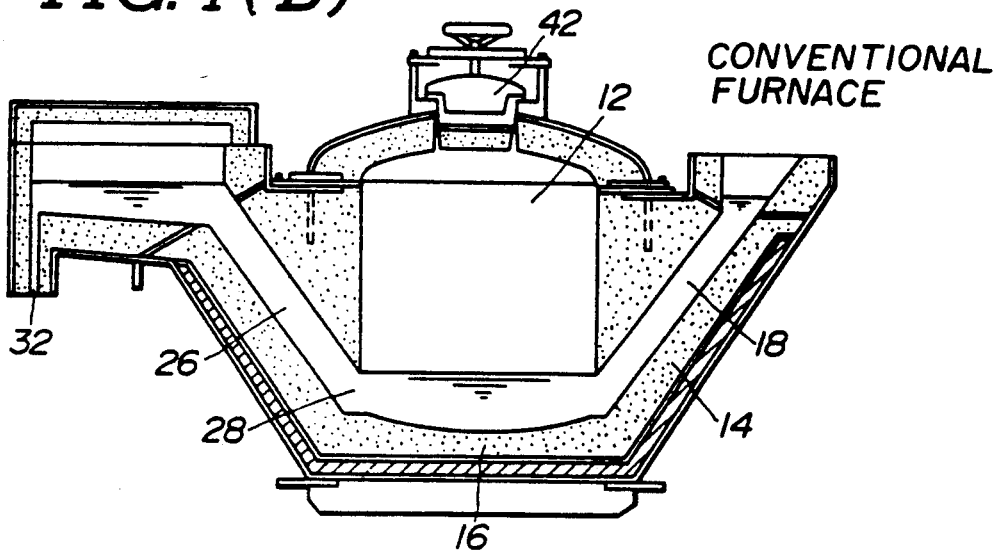

In the shown embodiment, the minimum level of the molten metal required is shown in FIG. 4(A). In order to compare the required minimum level of the molten metal in the conventional pouring furnace, an comparative example is shown in FIG. 4(B). As will be seen from FIG. 4(A), because of the presence of the stepped down section 34 on the floor 16 of the molten metal chamber 12, the required amount of molten metal is that needed to fill only the stepped down section 34. This is clearly smaller than that in the conventional furnace. Assuming the effective volume of the molten metal chamber 12 in the furnaces of FIGS. 4(A) and 4(B) are the same. e.g. 5.0 tons, the minimum amount of molten metal in the inventive furnace of FIG. 4(A) will be 1.4 tons to fill the outlet path 26 and the stepped down section 34. Therefore, in this case, the overall required amount of the molten metal becomes 6.4 tons. On the other hand, in order to maintain the conventional furnace of FIG. 4(B), the molten metal level has to be higher than or equal to the uppermost section of the inlet and outlet paths 18 and 26. Since the molten metal chamber 12 is pressurized, the volume of the molten metal should include amounts needed to fill the inlet and outlet path for maintaining the molten metal level higher than or equal to the uppermost section of the inner end openings of the inlet and outlet path. Consequently, for the shown example, minimum volume of the molten metal to be required will be 2.7 tons. In this case, the overall required amount of molten metal becomes 7.7 tons.

Therefore, with the shown construction of the pressure type automatic pouring furnace according to the present invention, the required minimum amount of molten metal to be filled in the molten metal chamber becomes approximately half that required in the conventional furnace.

In addition, according to the shown embodiment, since the induction heating section 36 communicates with the stepped down section 34 at the lowermost elevation, heat distribution of the molten metal in the molten metal chamber can be successfully maintained so as to prevent the molten metal from solidifying at the stepped down section 34 opposing the inner end opening 28 of the outlet path 26. That is, as is well known, the groove type induction heating device 40 may not have substantial stirring ability. Therefore, heat transmission from the induction heating device to the molten metal in the molten metal chamber 12 generally relies on natual convection. This means that the lower temperature molten metal will accumulate at the lower section in the chamber due to difference of the density. If the portion of the stepped down section 34 opposing the inner end opening 28 of the outlet path 26 is located at the lowermost elevation, the lowest temperature part of the molten metal in the molten metal chamber 12 will be accumulated in that portion of the stepped down section.

According to the present invention, since the stepped down section 34 is slanted toward the portion joining with the induction heating section 36, the lowest temperature molten metal flows to the joining section to be introduced into the induction heating system 36 which is located at further lower elevation that that of the joining section. This allows effective heating of the molten metal in the molten metal chamber 12 and thus prevents the molten metal from solidifying in the outlet path during pouring to the caster.

Figure 5:
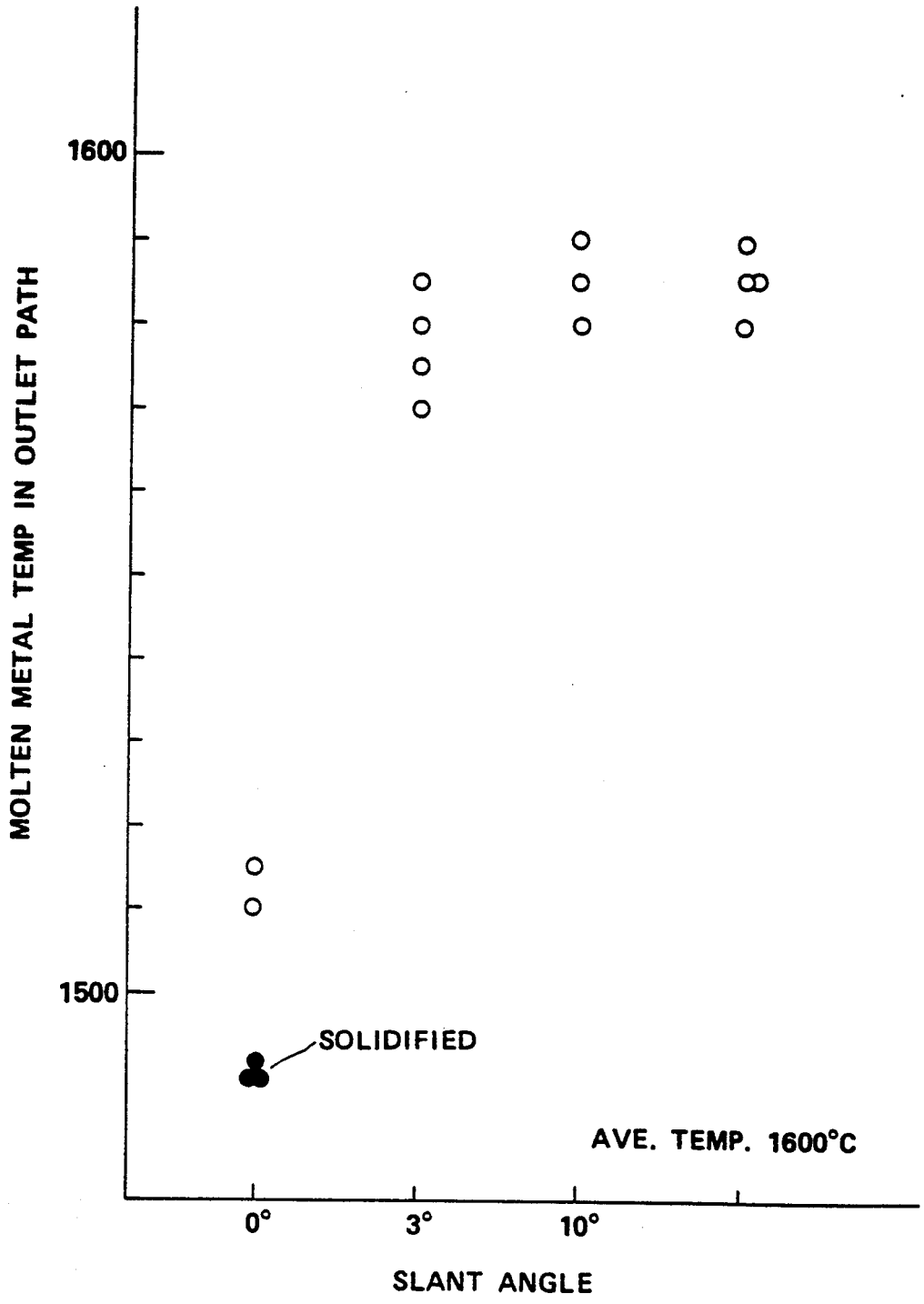
FIG. 5 is a graph showing molten metal temperatures in the outlet of the furnace.

In order to determine the slant angle of the stepped down section, experimentation has been performed to measure the temperature of the molten metal in the outlet path when the average temperature of the molten metal in the molten metal chamber 12 is maintained at 1600° C. The result has been shown in FIG. . As will be seen from FIG. 5, when the slant angle in the direction $\beta$ is greater than or equal to 3°, remarkable improvement could be observed. Therefore, by providing a slant angle greater than or equal to 3° with respect to the horizontal plane, the temperature of the molten metal in the outlet path 26 can be maintained satisfactorily high to successfully prevent solidification of the molten metal in the outlet path.

According to the shown embodiment, an additional advantage may be expected that, since the required molten metal amount for maintaining the minimum level is substantially reduced, electricity required for the induction heating device 40 for heating the molten metal can be reduced correspondingly.

In order to demonstrate the advantages of the shown embodiment of the furnace in comparison with the conventional furnace, an experimentation has been performed utilizing the furnaces of FIGS. 4(A) and 4(B). In the experimentation, pouring of SUS 430, SUS 308 and Incoroy 800 were performed in order. At first, 5.0 t of SUS 430 was poured to a corresponding caster for casting 5 t of ingot. Then, 2 t of SUS 308 ingot was cast by pouring molten SUS 308 by means of the furnaces of FIGS. 4(A) and 4(B). Finally, 2 t of Incoroy 800 ingot was cast by pouring the molten Incoroy 800 by means of the furnaces of FIGS. 4(A) and 4(B). Methods for supplying additional melt and yields of Ni, Cr and Fe are shown in the appended table 1.

In the aforementioned sequence of pouring and casting process, upon supplying additional melt at the transition between casting of SUS 430 and casting SUS 308, the Cr and Ni amount required in the inventive furnace of FIG. 4(A) was much smaller than that required in the conventional furnace of FIG. 4(B). On the other hand, in the transition between casting of the SUS 308 and casting of Incoroy 800, the molten metal in the molten metal chamber which was used for casting of SUS 308 was removed by inclining the furnaces. At this time, the removed amount of the melt was 0.2 t in the inventive furnace of FIG. 4(A). In comparison with this, the removed amount of the melt in the conventional furnace was 1.0 t. This indicates that by utilizing the inventive furnace of FIG. 4(A), the amount of the molten metal to be removed becomes substantially reduced in comparison with that of the conventional furnace of FIG. 4(B), even when the composition of the metal to be cast was substantially different. This makes it easier to cast various compositions of metals to be cast by means of the common pouring furnace.

The appended table 2 shows average consumed amounts of electricity through 3 months while the molten metal has been maintained within the furnace. As will be seen from table 2, according to the shown embodiment, the consumed electricity can be saved at 10 Kw in comparison with that in the conventional and comparative example of FIG.4(B).

Figure 6:
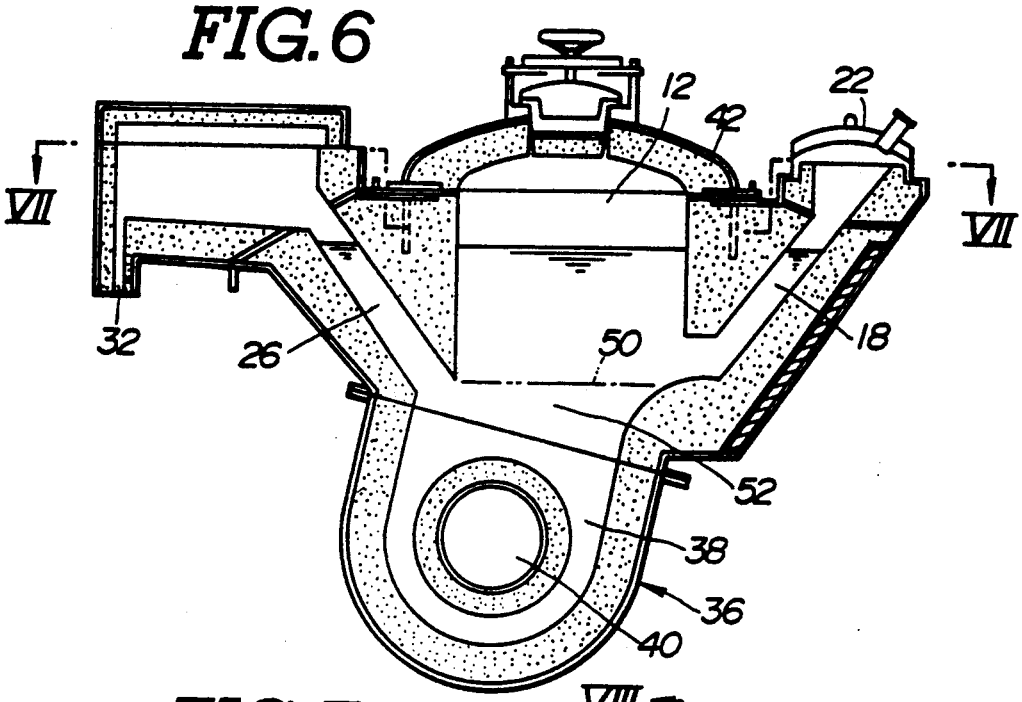
FIG. 6 is a cross-section of another preferred embodiment of a pressure type automatic pouring furnace according to the invention.
Figure 7:
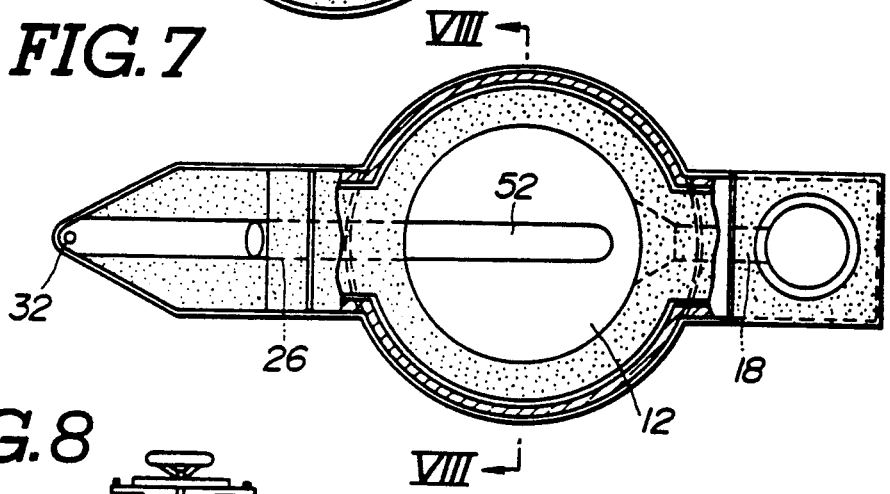
FIG. 7 is a section taken along line VII—VII of FIG. 6
Figure 8:
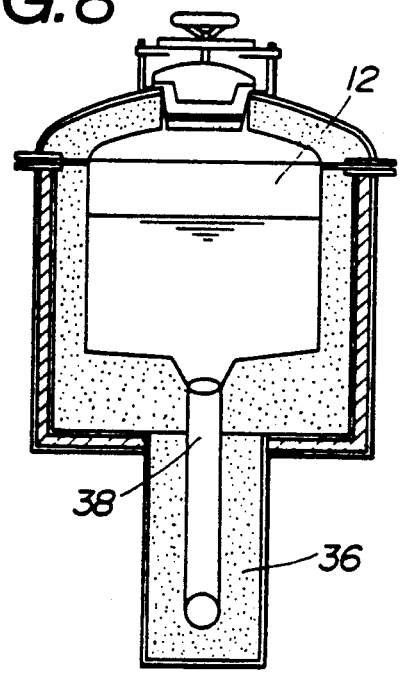
FIG. 8 is a section taken along line VIII—VIII of FIG. 7.

FIGS. 6, 7 and 8 show another embodiment of the pressure type automatic pouring furnace according to the invention. In this embodiment, the corresponding sections and components common to the foregoing embodiment of FIGS, 1 through 3 will be represented by the same reference numerals and thus detailed discussion is omitted in order to avoid redundancy of discussion and confusion.

In FIGS. 6, 7 and 8, the groove type induction heating section 30 is provided beneath the molten metal chamber 12 in the furnace 10. The circular molten metal path 38 communicates with a communication path 2 formed through the bottom of the molten metal chamber 12 directly. The inner end opening 28 of the outlet path 26 is directed to oppose one end of the molten metal path 38 in the induction heating section. Therefore, the molten metal to be introduced into the outlet path 26 may be the one heated by the induction heating section. This may successfully prevent the molten metal in the outlet path from solidifying.

Even in this case, the minimum level of the molten metal in the molten metal is that represented by the phantom line 50. Therefore, the minimum amount of the molten metal to maintain the minimum level 50 may be substantially reduced in comparision with that required in the conventional furnace.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| | INVENTIVE | COMPARATIVE |
|---|---|---|
| SUS 430 | SUPPLY 6.4 tons | SUPPLY 7.7 t |
| (Cr 13%, Ni 0%) | POUR 5.0 tons | POUR 5.0 t |
| | SUPPLY 2.0 tons | SUPPLY 2.0 t |
| | (Cr 25%, Ni 17% | (Cr 30%, Ni 24% |
| | Molten Steel) | Molten Steel) |
| SUS 306 | POUR 2.0 tons | POUR 2.0 t |
| (Cr 20%, Ni 10%) | REMOVE 0.2 tons | REMOVE 1.0 t |
| | SUPPLY 2.2 tons | SUPPLY 3.0 t |
| | (Cr 28% Ni Melt) | (Cr 28%, Ni Melt) |
| INCOROY 825 | POUR 2.0 tons | POUR 2.0 t |
| | REMOVE 1.4 tons | REMOVE 2.7 t |
| YIELD Ni | 62.4% | 45.5% |
| Cr | 79.6% | 63.5% |
| Fe | 92.9% | 82.0% |
| All Metal | 84.9% | 70.9% |

TABLE 2

| | AVERANGE MELT AMOUNT | ELECTRICITY |
|---|---|---|
| INVENTIVE | 2.1 tons | 156 Kw |
| COMPARATIVE | 3.4 tons | 166 Kw |

What is claimed is:

1. A pressure type automatic pouring furnace for casting, comprising:

a furnace body defining a chamber for receiving and processing a molten metal, said furnace having a floor which is slanted relative to the horizontal and to the remainder of the furnace body from an inlet end to an outlet end spaced from said inlet end;

a molten metal inlet opening extending through the wall of aid chamber, said inlet opening being connected through a passageway to a feed opening, said passageway being opened substantially to the bottom of said chamber at said inlet end;

a molten metal outlet at the lowermost point of said furnace chamber and extending through said furnace wall and in a depression positioned below the lowermost point of said furnace floor and having an outlet opening opened at said outlet end; said outlet opening being positioned lower than said inlet opening, and pressure means connected for introducing a pressure in said chamber for forcing the molten metal within said chamber to and through said molten metal outlet.

2. A pressure type automatic pouring furnace for casting, comprising:

a furnace body defining a chamber for receiving a molten metal;

a molten metal inlet extending through a furnace wall and having a first opening substantially at the bottom of said chamber;

a molten metal outlet extending through said furnace wall and having a second opening exposed to said chamber located substantially at the bottom of said chamber, orientation of said second opening relative to said first opening being so determined that said second opening is maintained below the molten metal level when at least part of said first opening is placed above said molten metal level;

pressure means for introducing pressure in said chamber for forcing the molten metal within said chamber to said molten metal outlet;

said pressure means comprising a pressure inlet defined above said chamber for introducing a pressurized gas into said chamber;

auxiliary pressure means associated with said molten metal inlet for introducing a pressurized gas into said chamber through said molten metal inlet;

said molten metal inlet and said outlet being located at the radially opposite positions;

said furnace body having a floor forming the bottom of said chamber, said floor being formed with a stepped down section adjacent said second opening of said molten metal outlet;

said second opening having an uppermost section oriented at an elevation substantially corresponding to the upper surface of said floor;

said floor being slanted from the side where said molten metal inlet is formed to the side where said stepped down section is formed; and a pathway also defined in said floor and communicating with said stepped down section, said pathway communicating with a heating means for heating the molten metal;

said groove being slanted towards said heating means, wherein said groove is provided with a slant angle greater than or equal to 3° with respect to a horizontal plane; wherein said heating means is an induction heating device comprising an electric heater and means defining a molten metal path surrounding said heater and communicating with said groove.

3. A pressure type automatic pouring furnace as set forth in claim 2, wherein said molten metal path defined in said induction heating device is oriented at an elevation lower than the communication with said groove.

4. A pressure type automatic pouring furnace for casting, comprising:

a furnace body defining a chamber for receiving a molten metal, said furnace having a floor with a groove;

a molten metal inlet extending through a furnace wall and having a first opening substantially at the bottom of said chamber;

a molten metal outlet extending through said furnace wall and having a second opening exposed to said chamber located substantially at the bottom of said chamber;

a pressure means for introducing pressure into said chamber for forcing the molten metal within said chamber to said molten metal outlet; and a heating means being an induction heating device comprising an electric heater and means defining a molten metal path surrounding said heater and communicating with said groove.

5. A pressure type automatic pouring furnace as set forth in claim 4, wherein said molten metal path defined in said induction heating device is oriented at an elevation lower than the communication with said groove.

6. A pressure type automatic pouring furnace as set forth in claim 4, wherein said molten metal path defined in said induction heating device opens to the bottom of said chamber.

7. A pressure type automatic pouring furnace for casting, comprising:

a furnace body defining a chamber for receiving a molten metal;

a molten metal inlet extending through a furnace wall and having a first opening substantially at the bottom of said chamber;

a molten outlet extending through said furnace wall and having a second opening exposed to said chamber, orientation of said second opening relative to said first opening being so determined that said second opening is maintained below the molten metal level when at least part of said first opening is placed above said molten metal level;

wherein said molten metal inlet and outlet are located at radially opposite positions;

wherein said furnace body has a floor forming the bottom of said chamber, said floor being formed with a stepped down section adjacent said second opening of said molten metal outlet;

wherein said second opening has an uppermost section oriented at an elevation substantially corresponding to the floor;

wherein said floor is slanted from the side where said molten metal inlet is positioned to the side where said stepped down section is positioned; and a pressure means for introducing pressure in said chamber for forcing the molten metal within said chamber to said molten metal outlet.

8. A pressure type automatic pouring furnace as set forth in claim 7, which further comprises a pathway also defined in said floor and communicating with said stepped down section, said pathway communicating with a heating means for heating the molten metal.

9. A pressure type automatic pouring furnace as set forth in claim 8, wherein said pathway is slanted toward said heating means.

10. A pressure type automatic pouring furnace as set forth in claim 9, wherein said pathway is provided with a slant angle greater than or equal to 3° with respect to a horizontal plane.

11. A pressure type automatic pouring furnace for casting, comprising:

a furnace body defining a chamber for receiving a molten metal;

a molten metal inlet extending through a furnace wall having a first opening substantially at the bottom of said chamber;

a molten metal outlet extending through said furnace wall and having a second opening exposed to said chamber, orientation of said second opening relative to said first opening being so determined that said second opening is maintained below the molten metal level when at least part of said first opening is placed above said molten metal level;

wherein said molten metal inlet and outlet are located at radially opposite positions;

wherein said furnace body has a floor forming the bottom of said chamber, said floor being formed with a stepped down section opposed to said second opening of said molten metal outlet;

wherein said second opening has an uppermost section oriented at an elevation substantially corresponding to the upper surface of said floor;

wherein said floor is slanted from the side where said molten metal inlet is formed to the side where said stepped down section is formed;

a pressure means for introducing a pressure in said chamber for forcing the molten metal within said chamber to said molten metal outlet, said pressure means comprising a pressure inlet defined above said chamber for introducing a pressurized gas into said chamber; and an auxiliary pressure means associated with said molten metal inlet for introducing a pressurized gas into said chamber through said molten metal inlet.

12. A pressure type automatic pouring furnace as set forth in claim 11, which stepped down section comprises a groove defined in said floor and communicating with said stepped down section, said groove communicating with a heating means for heating the molten metal.

13. A pressure type automatic pouring furnace as set forth in claim 12, wherein said groove is slanted toward said heating means.

14. A pressure type automatic pouring furnace as set forth in claim 13, wherein said groove is provided a slant angle greater than or equal to 3° with respect to a horizontal plane.

15. A pressure type automatic pouring furnace for casting, comprising:

a furnace body defining a chamber for receiving a molten metal;

a molten metal inlet extending through a furnace wall and having a first opening substantially at the bottom of said chamber;

a molten metal outlet extending through said furnace wall and having a second opening exposed to said chamber, orientation of said second opening relative to said first opening being so determined that said second opening is maintained below the molten metal level when at least part of said first opening is placed above said molten metal level; and a pressure means for introducing a pressure in said chamber for forcing the molten metal within said chamber to said molten metal outlet.

16. A pressure type automatic pouring furnace as set forth in claim 15, wherein said molten metal inlet and outlet are located at radially opposite positions.

17. A pressure type automatic pouring furnace as set forth in claim 16, wherein said furnace body has a floor forming the bottom of said chamber, said floor being formed with a stepped down section adjacent said second opening of said molten metal outlet.

18. A pressure type automatic pouring furnace as set forth in claim 17, wherein said second opening has an uppermost section oriented at an elevation substantially corresponding to the upper surface of said floor.

19. A pressure type automatic pouring furnace as set forth in claim 16, which further comprises a heating means provided beneath said chamber and communicating with the bottom of said chamber.

20. A pressure type automatic pouring furnace as set forth in claim 19, wherein said heating means is a groove type induction heating device comprising an electric heater and means defining a molten metal path surrounding said heater and communicating with said bottom of said chamber.

21. A pressure type automatic pouring furnace as set forth in claim 15 wherein said pressure means comprises a pressure inlet defined above said chamber for introducing a pressurized gas into said chamber.

22. A pressure type automatic pouring furnace as set forth in claim 21, which further comprises an auxiliary pressure means associated with said molten metal inlet for introducing a pressurized gas into said chamber through said molten metal inlet.

23. A pressure type automatic pouring furnace as set forth in claim 16, wherein said molten metal inlet and outlet are located at radially opposite positions.

24. A pressure type automatic pouring furnace as set forth in claim 23, wherein said furnace body has a floor forming the bottom of said chamber, said floor being formed with a stepped down section adjacent said second opening of said molten metal outlet.

25. A pressure type automatic pouring furnace as set forth in claim 24, wherein said second opening has an uppermost section oriented at an elevation substantially corresponding to the upper surface of said floor.

26. A pressure type automatic pouring furnace as set forth in claim 23, which further comprises a beating means provided beneath said chamber and communicating with the bottom of said chamber.

27. A pressure type automatic pouring furnace as set forth in claim 26, wherein said heating means is an induction heating device comprising an electric heater, and means defining a molten metal path surrounding said heater and communicating with said bottom of said chamber.

28. A pressure type automatic pouring furnace as set forth in claim 27, wherein said molten metal path defined in said induction heating device opens to the bottom of said chamber.

* * * * *

UNITED STATES PATENT AND TRADEMARK OFFICE

CERTIFICATE OF CORRECTION

PATENT NO. : 5,271,539

DATED : December 21, 1993

INVENTOR(S) : Michiharu Ozawa et al

It is certified that error appears in the above-indentified patent and that said Letters Patent is hereby corrected as shown below:

In Column 2, Line 33, delete "is".

In Column 3, Line 15, after "defining" insert --a--.

In Column 5, Line 30, after "example," insert --the--.

In Column 7, Line 8, delete "2" and substitute --52--.
Line 67, delete "aid" and substitute --said--.

Signed and Sealed this

Third Day of May, 1994

Bruce Lehman

*Attest:*

BRUCE LEHMAN

*Attesting Officer*

*Commissioner of Patents and Trademarks*